US007923638B2

(12) United States Patent
Kaczmarski

(10) Patent No.: US 7,923,638 B2
(45) Date of Patent: Apr. 12, 2011

(54) COMMUNICATIONS CABLE PROVIDED WITH A CROSSTALK BARRIER FOR USE AT HIGH TRANSMISSION FREQUENCIES

(75) Inventor: Andrew Kaczmarski, Liverpool (AU)

(73) Assignee: Prysmian Telecom Cables & Systems Australia Pty Ltd, Liverpool (AU)

( * ) Notice: Subject to any disclaimer, the term of this patent is extended or adjusted under 35 U.S.C. 154(b) by 1141 days.

(21) Appl. No.: 10/480,545

(22) PCT Filed: May 28, 2002

(86) PCT No.: PCT/AU02/00678

§ 371 (c)(1),
(2), (4) Date: Aug. 11, 2004

(87) PCT Pub. No.: WO02/103715

PCT Pub. Date: Dec. 27, 2002

(65) Prior Publication Data

US 2004/0262027 A1 Dec. 30, 2004

(51) Int. Cl.
*H01B 7/18* (2006.01)

(52) U.S. Cl. ..... 174/110 R; 174/113 R; 174/120 R; 174/120 SR

(58) Field of Classification Search ..... 174/110 R, 174/113 R, 120 R, 120 AR, 110 PM; 29/825; 156/51

See application file for complete search history.

(56) References Cited

U.S. PATENT DOCUMENTS 3,983,313 A 9/1976 Ney et al.
4,096,346 A * 6/1978 Stine et al. ..... 174/36
4,551,569 A 11/1985 Verne
5,043,530 A * 8/1991 Davies ..... 174/36
5,313,017 A * 5/1994 Aldissi ..... 174/36
5,329,064 A 7/1994 Tash et al.
5,378,856 A * 1/1995 Allen ..... 174/120 R
5,770,820 A 6/1998 Nelson et al.
5,956,445 A 9/1999 Deitz, Sr. et al.
6,288,340 B1 9/2001 Arnould (Continued)

FOREIGN PATENT DOCUMENTS

DE 42 38 809 A1 5/1994

(Continued)

OTHER PUBLICATIONS

Teruaki et al.; "Twisted Pair Cable"; Patent Abstracts of Japan, of JP 08-249944, Sep. 27, 1996.

(Continued)

*Primary Examiner* — William H Mayo, III
(74) *Attorney, Agent, or Firm* — Finnegan, Henderson, Farabow, Garrett & Dunner, L.L.P.

(57) ABSTRACT

A communications cable having a plurality of electrical conductor pairs, each of the pairs including two metallic conductors and each separately surrounded by insulation. An intermediate polymeric sheath has an inner and an outer surface and surrounds the plurality of electrical conductor pairs along substantially its entire length. An outer polymeric sheath has an inner and an outer surface, the inner surface of the outer polymeric sheath being disposed about the outer surface of the intermediate sheath along substantially its entire length. The outer surface of the intermediate sheath is bonded to the inner surface of the outer sheath along substantially its entire length. A method for reducing crosstalk in the cable and a method for manufacturing the cable is also disclosed.

3 Claims, 3 Drawing Sheets

U.S. PATENT DOCUMENTS

| | | | | |
|---|---|---|---|---|
| 6,301,414 | B1 | 10/2001 | Liese et al. | |
| 6,441,308 | B1 * | 8/2002 | Gagnon | 174/105 R |
| 6,717,058 | B2 * | 4/2004 | Booth et al. | 174/117 F |
| 6,800,811 | B1 * | 10/2004 | Boucino | 174/113 C |

FOREIGN PATENT DOCUMENTS

| | | | |
|---|---|---|---|
| EP | 0 422 306 | A1 | 4/1991 |
| EP | 0 749 130 | A1 | 12/1996 |
| EP | 0 964 408 | A1 | 12/1999 |
| EP | 0 990 932 | A1 | 4/2000 |
| GB | 1179320 | | 1/1970 |
| GB | 2 084 927 | A | 4/1982 |
| GB | 2260216 | A * | 4/1993 |
| WO | WO 95/24044 | | 9/1995 |
| WO | WO 97/41572 | | 11/1997 |

OTHER PUBLICATIONS

Daetwyler Kabel & System AG; "Data Transmission Cable Has Conducting Sleeve Made by Flame-Spraying, ARC-Spraying, Plasma-Coating, Evaporation, Galvanic or Chemical Precipitation or Dipping Process"; Derwent Abstract of DE 29907039 U1, Aug. 31, 2000.

* cited by examiner

COMMUNICATIONS CABLE PROVIDED WITH A CROSSTALK BARRIER FOR USE AT HIGH TRANSMISSION FREQUENCIES

CROSS REFERENCE TO RELATED APPLICATIONS

This application is a national phase application based on PCT/AU02/00678, filed May 28, 2002, and claims the priority of Australian Patent Application 51918/01, filed Jun. 14, 2001.

TECHNICAL FIELD

The present invention relates to a communications cable and a method of manufacture for such, and in particular, to data cables for the interconnection of digital electronic equipment, such as computers, which function at high transmission frequencies and adhere to industry standards.

BACKGROUND ART

High performance communications cables are required to allow future growth in computer networking speeds and other applications which require digital electronic equipment to communicate by the rapid transfer of data. Metallic core based communication cable, in particular of the "conductor pairs" type, allow digital electronic equipment to transmit/receive data via electrical signals transmitted at various transmission frequencies.

A high performance communications cable generally must achieve a high level of performance while adhering to industry standards such as requirements set by AS/NZS 3080:2000, ISO/IEC 11801:2000, EIA/TIA 568-A:1999, or NEMA WC 66:1999 standards. For example, EIA/TIA 568-A for Category 5 cables regulates the performance of communication cable up to a transmission frequency of 100 MHz.

In addition to impedance, attenuation, and crosstalk, the EIA/TIA 568-A standard specifies dimensional constraints that must be adhered to when manufacturing high frequency communication cables.

High performance communications cables which are capable of performing at high transmission frequencies while meeting or exceeding the relevant industry standards require special consideration to reduce factors such as the degree of crosstalk. The communication cables must achieve high transmission frequencies while maintaining the integrity of the transmitted data.

Crosstalk is an important factor in evaluating data cable performance. Crosstalk represents signal energy loss or dissipation due to coupling between conductors or components of the cable. Crosstalk coupling within a cable is related, among other factors, also to the dielectric constant of the materials used in the cable.

Communications cables with cores that have groups of conductor pairs (also known as "twisted pairs") in the same cable present the problem of crosstalk between the different groups of conductor pairs. With an increase in transmission frequency the crosstalk problem increases, and cables that were acceptable at a lower transmission frequency may be no longer adequate.

For manufacturing a communication cable, a polymeric sheath is extruded onto a plurality of such twisted pairs. In some cable designs, the polymeric sheath is extruded directly onto the twisted pair. Alternatively, the twisted pairs can first be grouped together by enclosure into a first thin sheath, e.g. by wrapping the group of twisted pairs with a polymeric tape, and then an outer sheath of polymeric material is extruded about the grouped twisted pairs. An example of such cable is sold by Pirelli Cables Australia Ltd under code L25P5.

The Applicant has however observed that such a design of cable may cause in some instances crosstalk problems in the transmitted signal. In the perception of the Applicant, these problems may be caused by an incomplete or irregular contact of an intermediate layer, disposed about the group of twisted pairs, with the outer polymeric sheath, with consequent impedance variation and crosstalk penalty caused by capacitance through the outer sheath.

The Applicant has thus observed that an improvement in the adhesion between said intermediate layer and the outer sheath of the cable could result in improved transmission properties of the cable.

SUMMARY OF INVENTION

A first aspect of the present invention relates to a communications cable comprising:

- a plurality of electrical conductor pairs, each of said pairs including two metallic conductors each separately surrounded by an insulation;
- an intermediate polymeric sheath, having an inner and an outer surface, disposed to surround with said inner surface said plurality of electrical conductor pairs along substantially its whole length; and
- an outer polymeric sheath, having an inner and an outer surface, the inner surface of said outer polymeric sheath being disposed about the outer surface of said intermediate sheath along substantially its whole length;

wherein the outer surface of said intermediate sheath is bonded to the inner surface of said outer sheath along substantially its whole length.

Preferably, said intermediate polymeric sheath is a polymeric tape wrapped around said plurality of conductors. Preferably, said intermediate polymeric sheath is thermally bonded to said outer sheath.

According to a preferred embodiment, the material of said intermediate sheath is a polyolefin, in particular polyethylene, polypropylene, or ethylene-propylene copolymer. Particularly preferred is foamed polypropylene or cellular foamed polypropylene tape.

According to a further preferred embodiment, the outer sheath material is polyvinyl chloride (PVC), a flame retardant material, low smoke PVC, or a zero halogen, flame retardant, low smoke compound.

According to a further preferred embodiment, any suitable material(s) may be utilised which provide an intermediate sheath that partially melts due to a known temperature increase.

Another aspect of the present invention relates to a method for reducing the crosstalk in a communications cable which comprises:

- a plurality of electrical conductor pairs, each of said pairs including two metallic conductors each separately surrounded by an insulation;
- an intermediate polymeric sheath, having an inner and an outer surface, disposed to surround with said inner surface said plurality of electrical conductor pairs along substantially its whole length; and
- an outer polymeric sheath, having an inner and an outer surface, the inner surface of said outer polymeric sheath being disposed about the outer surface of said intermediate sheath along substantially its whole length;

said method comprising the step of causing the outer surface of said intermediate sheath to bond to the inner surface of said outer sheath along substantially its whole length.

Preferably said method comprises thermally bonding the outer surface of said intermediate sheath to the inner surface of said outer sheath.

Broadly, the cable can be used as a Category 3, 4, 5, 5E, 6, 7, or 8 cable in accordance with data cable industry standards.

Another aspect of the present invention relates to a method for manufacturing a communication cable, which comprises:

arranging a plurality of electrical conductor pairs into a group;

arranging an intermediate sheath about said group of electrical conductor pairs;

arranging an outer sheath about said intermediate sheath;

causing said intermediate sheath to firmly bond to said outer sheath.

Preferably, the step of causing said intermediate sheath to firmly bond to said outer sheath comprises the step of partially melting said intermediate sheath for thermally bonding said intermediate sheath to said outer sheath.

A preferred embodiment of the above method of manufacturing comprises the steps of:

arranging a plurality of electrical conductor pairs into a group;

arranging an intermediate sheath about said group of electrical conductor pairs, to form a conducting core;

causing said conducting core to pass through an extruder;

extruding an outer sheath of polymeric material about said intermediate sheath, at a temperature which causes said intermediate sheath to melt at least in part;

cooling the so obtained cable, thus causing said intermediate sheath to bond to the outer sheath.

Preferably, the above temperature of the extruded material is controlled to avoid total melting of the intermediate sheath.

Preferably, the at least partial melt of said intermediate sheath is such that only the outer surface of said intermediate sheath contacted by said extruded material is molten.

Preferably, the temperature of the extruded material is kept from about 0° C. above to about 15° C. above the melting point of the material forming the intermediate sheath, more preferably from about 5° C. above to about 10° C. above the melting point of the said intermediate material. Particularly preferred is a temperature of the extruded material of about 5° C. greater than the melting temperature of the material forming the intermediate sheath.

The variation of the temperature of the extruded material is kept within a limited range around a predetermined temperature, preferably within a variation of about ±4° C. or less, more preferably within a variation of ±2° C. or less. In particular, said limited variation of the temperature of the extruded material is controlled in correspondence with four selected temperature zones, and with the clamp, head and die temperatures.

In another form of the invention there is provided a communications cable, substantially as described in the specification with reference to the accompanying figures.

In another form of the invention there is provided a method of manufacturing a communications cable, substantially as described in the specification with reference to the accompanying figures.

BRIEF DESCRIPTION OF FIGURES

The present invention will become apparent from the following description, which is given by way of example only, of a preferred but non-limiting embodiment thereof, described in connection with the accompanying figures, wherein.

DETAILED DESCRIPTION OF THE INVENTION

Figure 1:
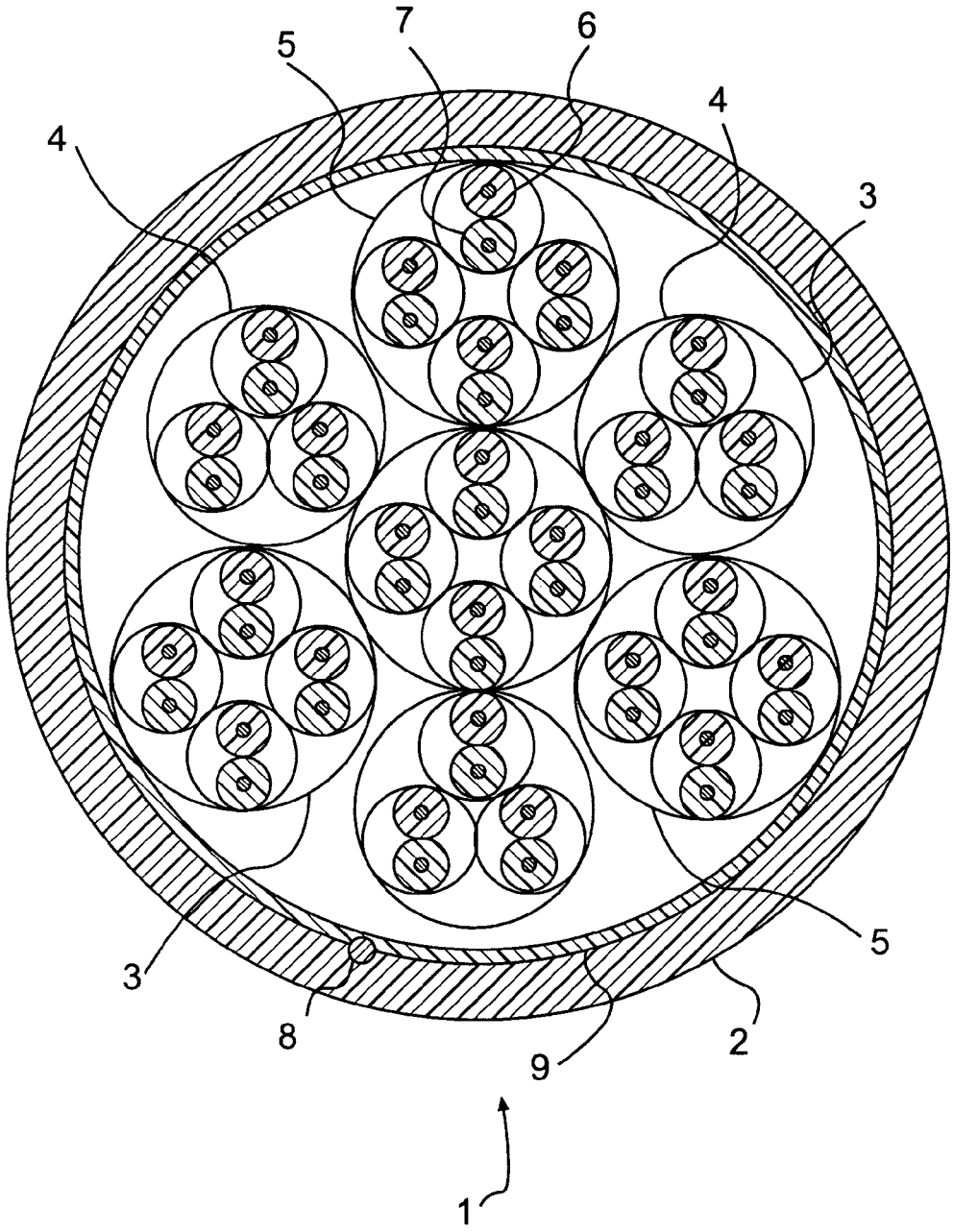
FIG. 1 illustrates an embodiment of the present invention wherein, the figure shows a cross-section of the components of the communications cable.

The present invention provides a communication cable provided with a crosstalk barrier, and/or, a method of manufacturing a communication cable provided with a crosstalk barrier. In the figures, incorporated to illustrate the features of the present invention, like reference numerals are used to identify like parts throughout the figures.

A preferred, but non-limiting, embodiment of the present invention is shown in FIG. 1. Referring to the figure, the communication cable 1 is comprised of a polyvinyl chloride (PVC) outer sheath 2, electrical conductor pairs 3, groups of three pairs of electrical conductors forming the units 4, and groups of four pairs of electrical conductors forming the units 5.

In the embodiment as illustrated, binder tapes hold the units 4 and 5 as a group of pairs of electrical conductors 3. Pairs of electrical conductors 3 consist of twisted single cables 6 and 7. Each electrical conductor cable 6 and 7 is provided with solid polyethylene insulation or other form of insulation.

The communications cable 1 may also be provided with ripcord 8 to assist in installation. The outer sheath 2 can be, for example, a flame retardant material, low smoke PVC material, or a low temperature grade of a zero halogen flame retardant low smoke compound, for example, Welvic 97/096/14 (PVC), Megolon S530, or Pirelli Afumex grades. Furthermore, an additional over-sheathing (not shown) placed about the outer sheath 2 could be used for outdoor or indoor applications without degradation or altering of the electrical parameters of the cable 1. The over-sheathing may be formed of low density polyethylene, nylon for termite protection, PVC, etc.

The communications cable 1 is provided with an intermediate sheath 9. The intermediate sheath 9 is made from a polymeric material preferably selected from polypropylene, polyethylene, or ethylene-propylene copolymers, said polymeric material being preferably used as an expanded polymer. More preferably, the intermediate sheath 9 is applied as a tape, which is preferably helically wrapped around the units 4 and 5. According to a particularly preferred embodiment, the tape is made from expanded polypropylene. For instance the foamed polypropylene tape sold under the tradename Lanzing by Multapex can be used.

The communications cable 1 can be manufactured by subjecting a communications cable having the previously mentioned components to a temporary increase in temperature at an extrusion zone during manufacture. For instance, when using the preferred expanded PP tape as the intermediate sheath 9, the temporary increase in temperature is preferably within the range of 160° C. to 180° C., but most preferably is within the range of 165° C. to 170° C. Of course, this range may alter depending upon the specific materials used in the cable 1.

The bonding between the intermediate sheath 9 and the outer sheath 2 is thus obtained by extruding the outer sheath 2 onto the intermediate sheath 9, which causes at least a partial melting of the intermediate sheath 9. Upon cooling of the cable 1, the intermediate sheath 9 then firmly adheres to the outer sheath 2.

The temperature of the melt of the material forming the outer sheath 2 shall thus be sufficiently high to cause said at least partial melting of the intermediate sheath 9. However, it is preferably not desirable that the intermediate sheath 9 melt totally as consideration should also be given to mechanical protection for the cable 1.

The conditions at the extrusion zone are thus selected to produce the desired environment which will result in an acceptable intermediate sheath—outer sheath interface. The temperature is important through the whole extruder but most critical is the melt temperature in correspondence with the extruder die, i.e. where the melt contacts the intermediate sheath.

Within the preferred temperature range the intermediate sheath 9 will partially melt and firmly adhere or bond to the outer sheath 2. This forms a mechanical contact between the intermediate sheath 9 and the outer sheath 2 which reduces crosstalk between the electrical conductor pairs. The interface layer between the intermediate sheath 9 and the outer sheath 2 is herein referred to as the intermediate layer interface.

The bonding between the intermediate sheath 9 and the outer sheath 2 provides a crosstalk barrier and characteristic impedance stabilisation for data transmitted in the cable 1 along the conductors 6 and 7. The cable may thus be used as a communications cable where data must be transmitted at relatively high frequencies (in the 1-500 MHz range) using electrical conductors such as copper wire.

The adhesion or bonding of the intermediate sheath 9 to the outer sheath 2 seeks to reduce any capacitive coupling between certain parts of the cable 1, such as for example, between electrical conductor pairs 3, between electrical conductor pairs 3 and the outer sheath 2, between the electrical conductor pair units 4 or 5, or between the electrical conductor pair units 4 or 5 and the outer sheath 2. It should be noted that crosstalk may be reduced by locating the intermediate sheath material in various locations within the cable 1.

The intermediate sheath 9 is preferably made of a foamed material which from a mechanical point of view does not change the dimensions of the insulation of the cable 1 during installation of the cable or re-winding of the cable.

The bonding is suitable for any number of pairs of electrical conductors. Large numbers of pairs of electrical conductors obtain improved benefits. In Local Area Networks (LANs), data or communication cables where the number of pairs of electrical conductors is over four are provided with maximum Near End Cross Talk (NEXT) margins and zero down-time. This provides both input impedance and Structure Return Loss (SRL) characteristics. This is especially so in the high-speed Category 8, 7, 6, 5 or 5E cables, these categories being industry standards or drafts provided by AS/NZS 3080, ISO/IEC 11801, TIA/EIA 568A, or NEMA WC 66 standards.

The temperature profile during extrusion is critical for the successful formation of a suitable intermediate layer interface which is required for high-speed networks. When successfully formed the intermediate layer interface helps to achieve higher crosstalk ratios between pairs of electrical conductors and the stable input impedance with return loss over the frequency range of operation of the particular cable.

Consideration in selection of the materials used for the intermediate sheath 9 and the outer sheath 2 should also take into account the ease with which a layer or sheath may be removed during installation of a cable.

The temperature at the extrusion zone of the cable 1 should preferably be limited to only vary to within about 4° C., but most preferably be limited to only vary to within about 2° C., so that a shift in this temperature does not result in either the intermediate sheath 9 completely melting or a suitable intermediate layer interface not forming.

The variation of the temperature of the extruded material contacting the intermediate sheath (i.e. in the die zone of the extruder) is preferably kept within a limited range around a predetermined temperature, and as mentioned above, preferably within a variation of about ±4° C. or less, more preferably within a variation of about ±2° C. or less. In addition, also the temperature along the whole extruder is controlled to undergo only to limited variations, in order to avoid possible overheating of the intermediate layer, so as to avoid the complete melting of the intermediate sheath 9 or other undesirable effects.

The temperature profile along the whole extruder is preferably controlled by at least a thermocouple or more precise temperature sensors. The polypropylene tape can be easy damaged or burned without proper monitoring of the temperature control zones during the sheathing process. During operation a few extruders can be used on the line but the direct jacket applied over the polypropylene tape is important.

Preferably, the temperature of the extruded material is kept from about 0° C. above to about 15° C. above the melting point of the material forming the intermediate sheath 9, more preferably from about 5° C. above to about 10° C. above the melting point of the said intermediate material. Particularly preferred is a temperature of the extruded material of about 5° C. greater than the melting temperature of the material forming the intermediate sheath. In particular, said temperature is referred to the temperature of the melt contacting the intermediate sheath inside the extruder, i.e. in the die zone of the extruder.

It is considered that foamed polypropylene tape has a more suitable dielectric constant than plain polypropylene tape or polyethylene tape and as such is a preferred material for the intermediate sheath 9.

The following embodiments are described as applied to the written description and appended claims in order to provide a more precise understanding of the subject matter of the present invention.

Figure 2:
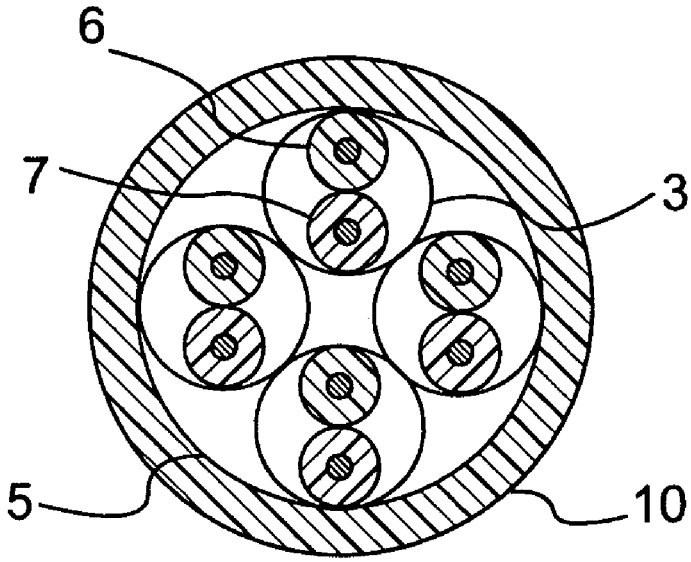
FIG. 2 illustrates a variation of the present invention.
Figure 3:
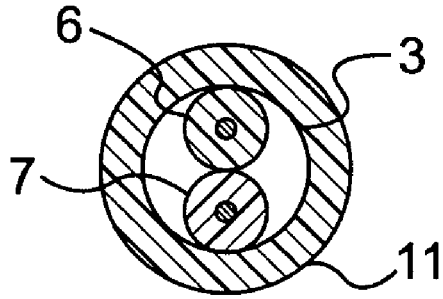
FIG. 3 illustrates a further variation of the present invention.

In FIGS. 2 and 3 various locations of the intermediate sheath 10 and 11 are illustrated. The intermediate sheath 10 is disposed about a unit 5 of pairs (or equally about a unit 4 of pairs). The intermediate sheath 11 is disposed about a pair of conductors 3. Both of these configurations can provide benefits to reducing crosstalk.

In each of the configurations in FIG. 2 and FIG. 3 at least part of the intermediate sheath 10 or 11 contacts at least part of the outer sheath 2 (not shown) so that when a temporary increase in temperature is applied to the cable this region of contact will form a intermediate layer interface. Hence, it is possible that distinct areas of intermediate layer interfaces may be present in the cable and it is not necessary that a complete annular intermediate layer interface be formed.

Each of the configurations illustrated in FIG. 1, FIG. 2 and FIG. 3 may be used in any combination, that is separately or together. For example, in a 25 pair cable as illustrated in FIG. 1, a combination of 3 and 4 pair units is preferably used.

The internal configuration and number of electrical conductors 6 and 7, and units 4 and 5, can be significantly varied. Also, other members or components typically used in communication cables may be provided and would generally not hinder the present invention. For example, reinforcing members, binding tape, or other components may be included in the cable 1.

An embodiment of the present invention appears similar to a standard cable except for the essential intermediate layer interface formed between the foamed polypropylene tape and low smoke, flame retardant PVC sheath. The outer sheath 2 can be thinner because of the additional strength provided by the intermediate sheath 9 (foamed polypropylene tape). The minimum bend radius is only slightly higher than a standard cable but provides additional protection for the conductor pairs. The intermediate sheath 9 is soft on the inside of the cable to avoid any damage to the insulation of the pairs of electrical conductors 6 and 7 despite rough handling during installation. Hence, the present invention also provides a more durable cable.

It should be realised that the present invention is directed towards the bonding of an intermediate sheath 9, such as polypropylene tape with different oxygen indexes, to any compound or material used as the outer sheath 2, with multiple sheaths possibly existing about the outer sheath 2 (in which case the sheath 2 is not the outermost sheath).

Figure 4:
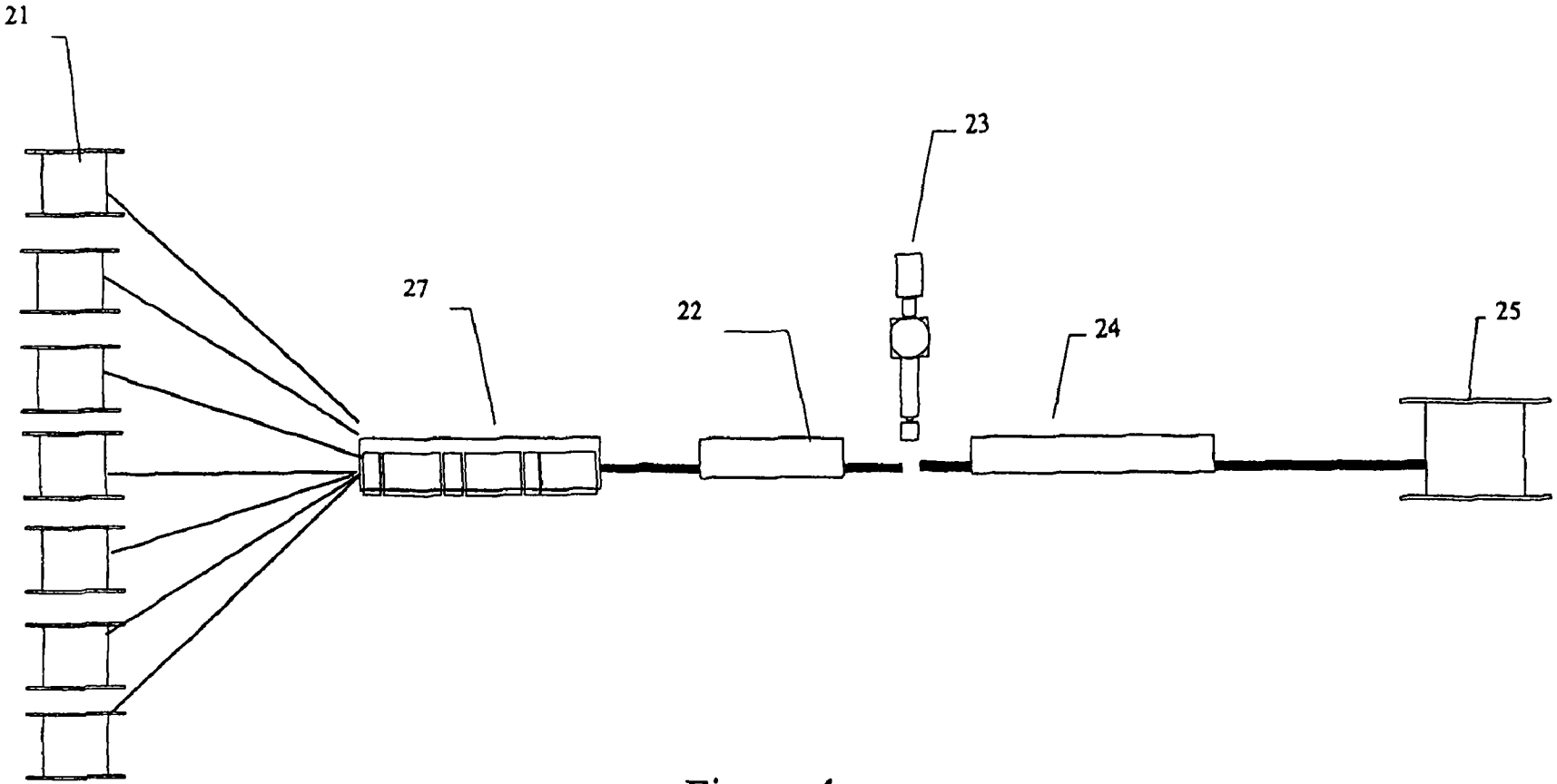
FIG. 4 illustrates apparatus providing a method of manufacturing a cable in accordance with the present invention.

Illustrated in FIG. 4 is a schematic representation of an apparatus 20 providing for a method of manufacturing a cable in accordance with the present invention. A plurality of twisted pairs, preferably stranded in groups of three or four pairs, is fed from a plurality of pay off bobbins 21 in a known manner. The groups of stranded twisted pairs are then stranded together in the stranding device 27 and then passed through tape applicator apparatus 22 where the intermediate sheath is applied. The extruder 23 applies the outer sheath about the intermediate sheath, in such a manner as to cause the surface of said intermediate sheath to bond to the inner surface of said outer sheath along substantially its whole length. In particular, as mentioned above, the material forming the outer sheath is extruded onto the intermediate sheath at a temperature sufficiently high (preferably about 5° C. higher than the melting temperature of the material forming the intermediate sheath) such as to cause a partial melt of the tape forming said intermediate sheath, with subsequent bonding of the two sheaths, in particular upon cooling of the cable. At the exit from the extruder, the cable is thus passed through a water trough 24 and then a tractor 25 assists in the cable being wound onto a take up drum.

The following examples provide a more detailed description of an embodiment of the present invention. These examples are intended to be merely illustrative and not limiting of the scope of the present invention.

In one form, a cable according to the invention comprises 25 pairs of conductors, each pair comprising two copper conductors (0.91 mm diameter), each insulated with PE (thickness 0.2 mm), pairs are stranded and grouped into 3 bundles of three pairs each and 4 bundles of four pairs. The bundles of pairs are then grouped together and an intermediate PP tape (Lanzing™ from Multapex) (thickness 125 micron) is wrapped around the grouped bundles. An outer PVC sheath (thickness 1.0 mm, such as Welvic 97/096/14) is then extruded onto the wrapped PP tape at a temperature of about 165° C., thus causing the partial melt of the latter and its bonding to said PVC sheath.

A comparative cable according to the prior art has been manufactured similarly, with the only difference that the intermediate tape was a Polyester tape (HIS™ from Multapex) which, due to its higher melting temperature (240° C. instead of the 160° C. of the PP tape) was not bonded to the outer PVC sheath.

The cable in accordance with the present invention obtains improved performance over a standard cable with at least 6 dB Near End Crosstalk loss, the characteristic impedance is more stable within 6 ohms instead 15 ohms, the return loss is 15 dB over the standard margin, the structure return loss is 15 dB over the limit, the Power Sum Near End Crosstalk loss is at least within the 5 dB margin, the Equal Level Far End Crosstalk loss has a 7 dB margin to the standard cable. The above comparison of performance between the bonding invention and the standard cable is proved by test results for Category 5E and Category 5 cables which are reproduced in the following tables.

25 Pair Category 5 Cable with bonding between the polypropylene tape and PVC sheath

| Cable Characteristic @ 20 degC. | Units | MHz | Value | Test Result | Standard Construction |
|---|---|---|---|---|---|
| Characteristic Impedance | ohm | 0.064 | 125 +/− 25 | 122 | 115 |
| | | >=1 | 100 +/− 15 | 101 | 95 |
| DC conductor resistance | ohm/100 m | DC | 19.2 | 8.5 | 8.5 |
| Resistance unbalance | % | DC | 3 | 1 | 2 |
| Minimum DC insulation resistance | Mohm · km | DC | 150 | 5000 | 5000 |
| Nominal Phase Velocity of Propagation | | 1 | 0.4 C | 0.68 C | 0.67 C |
| | | 10 | 0.6 C | 0.68 C | 0.67 C |
| | | 100 | NA | | |
| Minimum Near End Crosstalk Loss | dB@100 m | 0.772 | 64 | 70 | 65 |
| | | 1 | 62 | 69 | 63 |
| | | 4 | 53 | 60 | 54 |
| | | 8 | 47 | 55 | 48 |
| | | 16 | 44 | 51 | 45 |
| | | 20 | 42 | 49 | 43 |
| | | 31.25 | 40 | 47 | 41 |
| | | 62.5 | 35 | 42 | 36 |
| | | 100 | 32 | 39 | 33 |
| Maximum Longitudinal Conversion Loss | dB | 0.064 | 43 | 27 | 32 |
| Maximum Capacitance Unbalance to Ground | pF/km | 0.001 | 3400 | 1600 | 2200 |
| Dielectric strength conductor to conductor | | DC | 1 kV for 1 min or 2.5 kV for 2 s | Pass | Pass |
| | | AC | 700 V for 1 min or 1.7 kv for 2 s | Pass | Pass |

-continued

| 25 Pair Category 5 Cable with bonding between the polypropylene tape and PVC sheath | | | | | |
|---|---|---|---|---|---|
| Cable Characteristic @ 20 degC. | Units | MHz | Value | Test Result | Standard Construction |
| Minimum Structural Retum Loss | dB/100 m | 1 to <10 | 23 | 38 | 30 |
| | | 10 to <16 | 23 | 40 | 32 |
| | | 16 to <20 | 23 | 39 | 31 |
| | | 20 to 100 | 23log(f-20) | 35 | 30 |
| Maximum Attenuation | dB/100 m | 0.064 | 0.8 | 0.62 | 0.7 |
| | | 0.256 | 1.1 | 0.94 | 1 |
| | | 0.512 | 1.5 | 1.39 | 1.43 |
| | | 0.772 | 1.8 | 1.69 | 1.73 |
| | | 1 | 2.1 | 1.8 | 1.92 |
| | | 4 | 4.3 | 3.7 | 4.1 |
| | | 10 | 6.6 | 5.9 | 6.3 |
| | | 16 | 8.2 | 7.6 | 7.9 |
| | | 20 | 9.2 | 8.5 | 8.9 |
| | | 31.25 | 11.8 | 10.7 | 11.1 |
| | | 62.5 | 17.1 | 15.4 | 15.9 |
| | | 100 | 22 | 19.2 | 20 |
| The cable passes. | | | | | |

These standard tests to refer to Standard AS3080.

Thus, there has been provided in accordance with the present invention, a communication cable provided with a crosstalk barrier, and/or, a method of manufacturing a communication cable provided with a crosstalk barrier, which satisfies the advantages set forth above.

The invention may also be said to consist in the parts, elements and features referred to or indicated in the specification of the application, individually or collectively, in any or all combinations of two or more of said parts, elements or features, and where specific integers are mentioned herein which have known equivalents in the art to which the invention relates, such known equivalents are deemed to be incorporated herein as if individually set forth.

Although the preferred embodiment has been described in detail, it should be understood that various changes, substitutions, and alterations can be made herein by one of ordinary skill in the art without departing from the scope of the present invention as hereinbefore described and as hereinafter claimed.

The claims defining the invention are as follows:

1. A method of manufacturing a communications cable which comprises the steps of:

arranging a plurality of electrical conductor pairs into a group;

arranging an intermediate sheath to contact and surround said group of electrical conductor pairs, to form a conducting core;

passing said conductor core through an extruder;

extruding an outer sheath of polymeric material about said intermediate sheath, at a temperature which causes said intermediate sheath to melt at least in part, thereby forming a partial melt of said intermediate sheath; and cooling the so obtained cable, thus causing said intermediate sheath to bond to the outer sheath.

2. The method according to claim 1, wherein the temperature of extruded material is controlled to avoid total melting of the intermediate layer.

3. The method according to claim 1, wherein the at least partial melt of said intermediate layer is such that only the outer surface of said intermediate sheath contacted by said extruded material is molten.

* * * * *

UNITED STATES PATENT AND TRADEMARK OFFICE

CERTIFICATE OF CORRECTION

PATENT NO. : 7,923,638 B2
APPLICATION NO. : 10/480545
DATED : April 12, 2011
INVENTOR(S) : Kaczmarski It is certified that error appears in the above-identified patent and that said Letters Patent is hereby corrected as shown below:

Title Page, after Item (65), the "Prior Publication Data", and before Item (51), the "Int. Cl." data, insert --(30) Foreign Application Priority Data

Jun. 14, 2001 (AU) .....51918/01--.

Signed and Sealed this
Fourth Day of October, 2011

David J. Kappos

David J. Kappos
*Director of the United States Patent and Trademark Office*